US010259536B1

(12) United States Patent
Knapp

(10) Patent No.: US 10,259,536 B1
(45) Date of Patent: Apr. 16, 2019

(54) SWIVEL SUBSEA ANCHOR SYSTEM

(71) Applicant: Timothy Knapp, Silverdale, WA (US)

(72) Inventor: Timothy Knapp, Silverdale, WA (US)

( * ) Notice: Subject to any disclaimer, the term of this patent is extended or adjusted under 35 U.S.C. 154(b) by 0 days.

(21) Appl. No.: 16/141,449

(22) Filed: Sep. 25, 2018

Related U.S. Application Data

(60) Provisional application No. 62/563,325, filed on Sep. 26, 2017.

(51) Int. Cl.
*B63B 21/26* (2006.01)
*B63B 21/38* (2006.01)
*B63B 22/00* (2006.01)

(52) U.S. Cl.
CPC ..... *B63B 21/26* (2013.01); *B63B 21/38* (2013.01); *B63B 22/00* (2013.01)

(58) Field of Classification Search
CPC ..... B63B 22/00; B63B 21/26; B63B 21/38
See application file for complete search history.

(56) References Cited

U.S. PATENT DOCUMENTS 3,496,900 A * 2/1970 Mott ..... B63B 21/27 114/296
3,846,991 A * 11/1974 Wisotsky ..... E02B 17/02 173/1
4,390,307 A * 6/1983 Rice ..... E02D 7/00 173/117
5,915,326 A * 6/1999 Karal ..... B63B 21/27 114/294

* cited by examiner

*Primary Examiner* — S. Joseph Morano
*Assistant Examiner* — Jovon E Hayes
(74) *Attorney, Agent, or Firm* — Dean A Craine

(57) ABSTRACT

An anchor system for a floating object that includes an eyelet mounted on a rotating swivel arm. The eyelet is adapted to connect to a rope or cable that extends downward from the floating object. The swivel arm is adapted to rotate freely 360 degrees around a rigid support pole. The lower end of the support pole includes at least one support flange that is imbedded into a concrete block during manufacturing. The swivel arm includes a horizontal flange with a center bore adapted to receive the support pole. The support pole includes a lower stop surface and an upper stop surface. When assembled, the swivel arm is mounted on the support pole so that the horizontal flange is positioned between the lower and upper stop surfaces. Disposed around the support pole and between the horizontal flange and the upper and lower stop surfaces are upper and lower nylon washers.

5 Claims, 2 Drawing Sheets

SWIVEL SUBSEA ANCHOR SYSTEM

This U.S. non-provisional patent application is based on and claims the filing date benefit of U.S. provisional patent application (Application No. 62/563,325) filed on Sep. 26, 2017.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to subsea anchors used to hold buoys and other types of lightweight floating objects in a relatively stationary location on a body of water.

2. Description of the Related Art

Water front homeowners place floating buoys 50 to 100 yards out from the shoreline and directly in front of their homes to designated protected swimming areas. The buoys are attached to lines or cables (hereinafter called buoy lines) that extend downward into the water and attached to anchors resting on the subsea floor. Wind, waves and changing sea levels exerted a wide variety of forces from different angles on the buoys, the buoy lines, the anchors and the hardware that connect the buoy lines to the buoys and to the anchors.

There are many different types of anchors commonly used with buoys. One type, commonly used by homeowners and boating anchors, is delta or claw style anchor that is relatively lightweight (i.e. 10 lbs) and has flukes or claws configured to grip or penetrate the subsea floor, thereby preventing it from being dragged over the subsea floor. Another type of anchor is called a mushroom anchor that include a large half-spherical member with an upward extending mast.

Is it also common for homeowners to attach a concrete (8×8×8) inch or (8×8×16) inch block to the end of the buoy line. Because such blocks do not have hooks or eyelets, homeowners typically extend the end of the buoy line through the block's center hole. Unfortunately, the section of the buoy line contacting the block is gradually abraded or the sidewalls on these concrete blocks break, enabling the buoy to float away.

Ideally, what is needed is a durable anchor system that attaches to a buoy line and configured to handle the wide variety of forces exerted at different angles on a buoy and is also used with a concrete block that can be manufactured locally in different sizes or shapes.

SUMMARY OF THE INVENTION

A swivel subsea anchor system that attaches to a buoy line attached to a buoy or other floating object, such as a raft, dock or boat, that is configured to handle a wide variety of forces exerted on the buoy. The system includes an anchor bracket that is partially imbedded into a concrete block. The anchor bracket includes a support pole that includes a lower section that is imbedded into the concrete block and an upper section that extends upward from the top surface of the concrete block. Affixed to the end of the upper section of the support pole is a fixed, rounded eyelet configured to be attached to a drop line used to lower the anchor to the subsea floor. Also mounted on the upper section of the support pole is a swivel arm that includes a horizontal flange and a diagonal flange. The swivel arm is adapted to rotate freely, 360 degrees around the support pole. Formed near the distal end of the diagonal flange is a grommet or bushing adapted to connect to a buoy line that attaches to a buoy, raft, dock or boat.

During manufacturing, the horizontal flange of the swivel arm is positioned between the lower and upper stop surfaces formed on the support arm's upper section. The lower and upper stop surfaces are sufficiently spaced apart so that the swivel arm may freely rotate 360 degrees and limit the upward and downward longitudinal movement of the swivel arm on the support pole. Disposed around the support pole and between the horizontal flange and the upper stop member and between the horizontal flange and the lower stop surface is at least one nylon washer made for underwater applications.

The concrete block can be made in any size or shape depending on the amount of weight needed to hold the buoy in place. In the preferred embodiment, the size and shape of the concrete block should be sufficient so that at least two inches of coverage is provided on all sides of the support flange and the support pole.

The support pole and swivel arm may be distributed and sold separately, sold with a block form that is used to make a concrete block or it may be distributed and sold attached to a manufactured concrete block.

DESCRIPTION OF THE PREFERRED EMBODIMENT(S)

Figure 1:
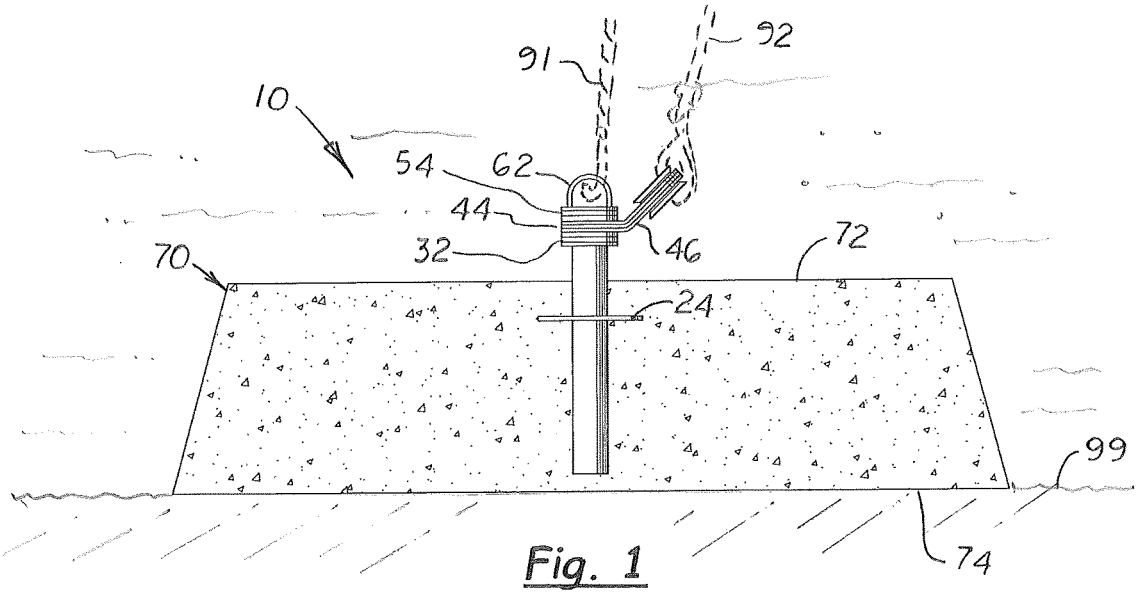
FIG. 1 is an illustration of an anchor system used to restrain a floating object.
Figure 2:
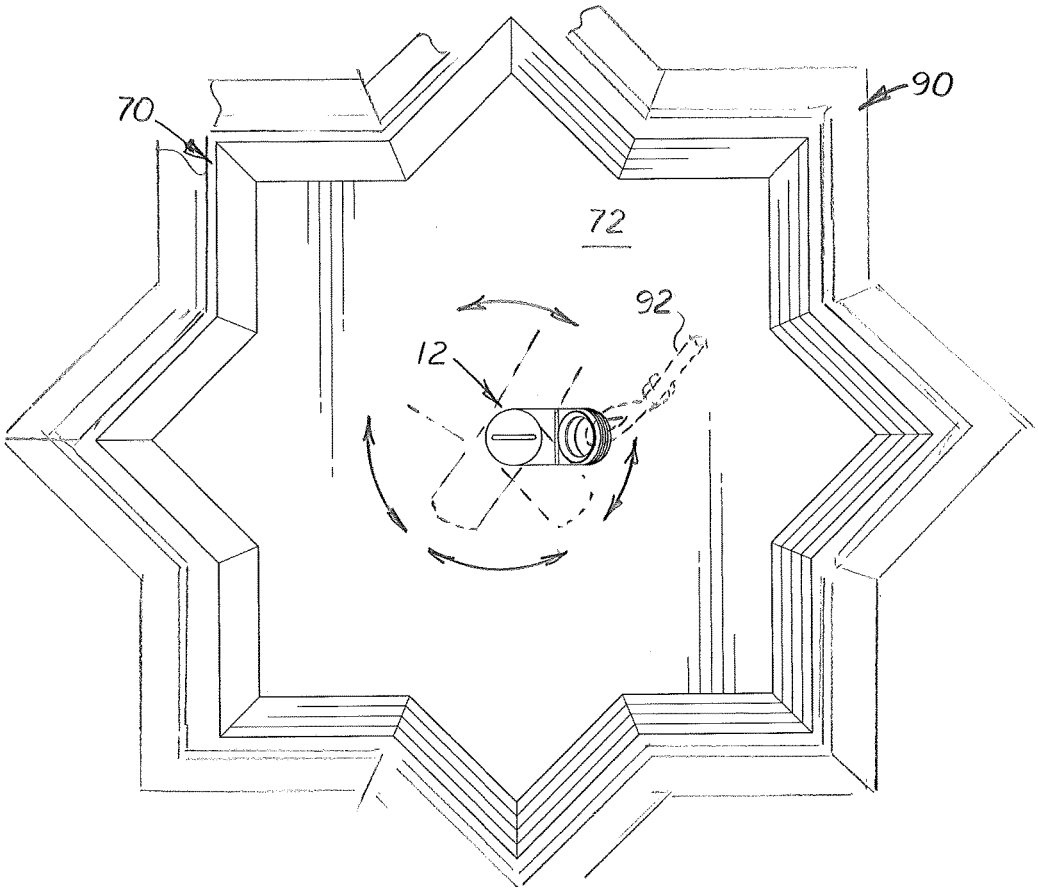
FIG. 2 is a top plan view of the anchor system shown in FIG. 2.
Figure 3:
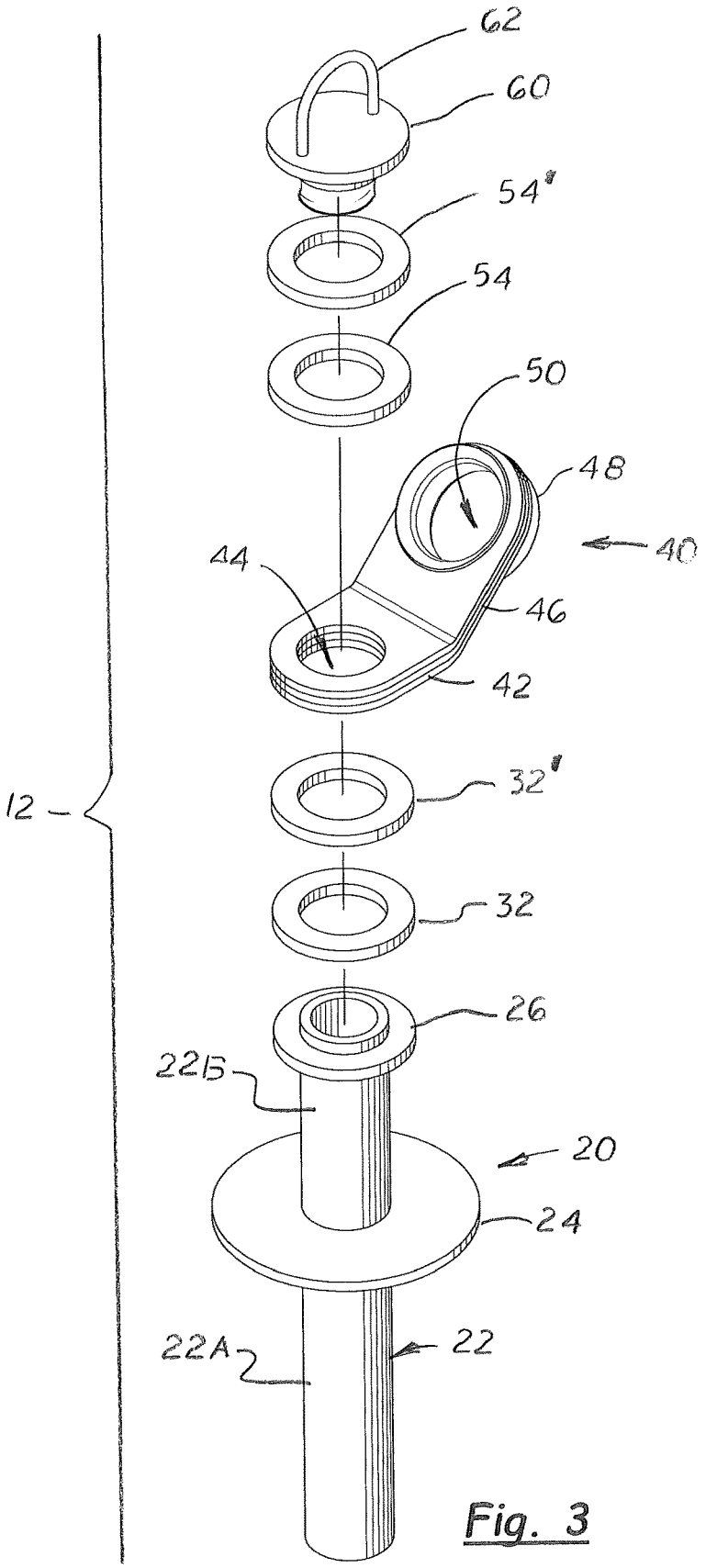
FIG. 3 is an exploded perspective view of the anchor support pole system.

Referring to the FIGS. 1-3, there is shown swivel subsea anchor system 10 for floating object, such as a buoy, dock or boat, that includes an anchor bracket 12 attached to a concrete block 70. The anchor bracket 12 includes a support pole 22 that includes a lower section 22A that is imbedded into the concrete block 70 and an upper section 22B configured to extend upward from the top surface 72 of the concrete block 70.

Affixed to the end of the upper section 22B of the support pole 22 is a longitudinally aligned, fixed eyelet 62.

Located on the upper section 22B of the support pole 22 is a swivel arm 40 that includes a horizontal flange 42 and a diagonal flange 46. Formed on the horizontal flange 42 is a center bore 44 that receives the support pole 22. The bore 44 is slightly larger in diameter than the support pole 22 thereby enabling the swivel arm 40 rotate freely 360 degrees around the support pole 22.

Formed on the diagonal flange 46 is a grommet 48 that includes a center bore 50. The upper and lower edges of the grommet 48 are rounded or beveled thereby minimizing abrasions to the buoy line 92.

The support pole 22 includes a lower stop surface 26 and an upper stop surface 60. The middle section 22B of the support pole 22 is circular in cross-section and is inserted into the center bore 44 on the swivel arm 40. During manufacturing, the horizontal flange 42 on the swivel arm 40 is positioned between the lower and upper stop surfaces 26, 60 which prevents the swivel arm 40 from moving longitudinally over the support pole 22. Disposed around the support pole 22 and between the horizontal flange 42 and the upper stop surface 60 is at least one nylon washer 54. Disposed around the support pole 22 and between the horizontal flange 42 and the lower stop surface 26 is at least one nylon washer 32. In the embodiment shown, in FIG. 3, two lower nylon washers 32, 32' and two upper nylon washers 54, 54' are used.

Mounted or attached to the lower section 22A of the support pole 22 below the lower stop surface 26 is at least one support flange 24. During assembly, the lower section 22A of the support pole 22 and the support flange 24 are imbedded into the concrete block 70. The support flange 24 is approximately twice the diameter of the support pole 22.

The concrete block 70 can be made in any size or shape depending on the amount of weight needed to hold the floating object in place on the subsea floor 99. In the embodiment shown in FIGS. 1 and 2, the concrete block 70 has a short pyramidal shape and the bottom surface 74 of the concrete block 70 is flat and measures approximately 48 inches and the top surface measures approximately 36 inches. The concrete block 70 is approximately 12 inches thick and weights approximately 500 lbs. Short, pyramidal or conical shapes are desirable because they are resistance to turning over or being dragged over the subsea floor 99. In each embodiment, however, the thickness of the concrete block 70 should be sufficient so that at least two inches of concrete coverage is provided on all sides of the support flange 24 and the support pole 22.

The anchor bracket 12 may be distributed and sold separately, it may be sold imbedded into a concrete block 70 or distributed and sold in a kit configuration with a concrete form 90 that is assembled by the installer who then fills the form 90 with concrete to make a block 70 of a desired size or shape as shown in FIG. 2.

In the embodiment shown herein, the support pole 22 is approximately 2 inches in diameter and 12 inches in length. The swivel arm 40 is a plate structure approximately 3 inches in width and 6 inches in length. The diagonal flange 46 is disposed at a 45 degrees from the horizontal flange 42. The center bore 44 formed in the horizontal flange 42 is approximate 2⅛ inches in diameter. The support flange 24 is circular and approximately 5 inches in diameter and ¼ inch thick. The main bore 50 formed in the grommet 48 is approximately 2¼ inches in diameter. The stop surfaces 26, 60 are circular plates approximately 3 inches in diameter. The nylon washers 32, 32', 54, and 54' are approximately 3 inches in diameter and ¼ inch thick. The support pole 22, the swivel atm 40 and eyelets 48 and 60 are made of stainless steel or galvanized steel.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A subsea anchor system for a floating object, comprising a. a concrete block with a top surface and a bottom surface;

b. an anchor bracket attached to said concrete block, said anchor bracket includes a support pole with a lower section and an upper section, said support pole includes a fixed, upper stop surface and a fixed, lower stop surface formed on said upper section, said support pole also include a at least one support flange disposed below said lower stop surface, said support pole includes an upper end with a longitudinally aligned eyelet affixed thereto;

c. a swivel attn that includes a horizontal flange and a diagonal flange, formed on said horizontal flange is a center bore adapted to receive said support pole and allow said swivel arm to rotate 360 degrees around said support pole, said diagonal flange aligned upward between 30 to 60 degrees from said horizontal flange and includes a distal end with a grommet attached near said distal end;

d. at least one lower nylon washer disposed between said horizontal flange and said lower stop surface when said swivel arm is mounted on said support pole; and e. at least one upper nylon washer disposed between said horizontal flange and said upper stop surface when said swivel arm is mounted on said support pole.

2. The anchor system, as recited in claim 1, wherein said support pole and said swivel arm are made of galvanized steel or stainless steel.

3. A subsea anchor bracket, comprising a. a support pole with a lower section and an upper section, said support pole includes a fixed, upper stop surface and a fixed, lower stop surface formed on said upper section, said support pole also include at least one support flange disposed below said lower stop surface, said support pole includes an upper end with a longitudinally aligned eyelet affixed thereto;

b. a swivel arm that includes a horizontal flange and a diagonal flange, formed on said horizontal flange is a center bore adapted to receive said support pole and allow said swivel arm to rotate 360 degrees around said support pole, said diagonal flange aligned upward between 30 to 60 degrees from said horizontal flange and includes a distal end with a grommet attached near said distal end;

c. at least one lower nylon washer disposed between said horizontal flange and said lower stop surface when said swivel arm is mounted on said support pole; and d. at least one upper nylon washer disposed between said horizontal flange and said upper stop surface when said swivel arm is mounted on said support pole.

4. The anchor system, as recited in claim 3, wherein said support pole and said swivel arm are made of galvanized steel or stainless steel.

5. The anchor system, as recited in claim 3, further including a form configured to be filled with concrete to form a concrete block used with said support pole.

* * * * *